US009424787B2

(12) United States Patent
Park et al.

(10) Patent No.: US 9,424,787 B2
(45) Date of Patent: Aug. 23, 2016

(54) LIQUID CRYSTAL DISPLAY DEVICE AND DRIVING METHOD THEREOF

(71) Applicant: LG Display Co., Ltd., Seoul (KR)

(72) Inventors: Yong Beom Park, Cheongju-si (KR); Jung Youl Kang, Chilgok-gun (KR); Kyoung Koo Lee, Gumi-si (KR); Han Su Kim, Daegu (KR); Jin Hee Lee, Ulsan (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/078,266

(22) Filed: Nov. 12, 2013

(65) Prior Publication Data

US 2014/0176408 A1 Jun. 26, 2014

(30) Foreign Application Priority Data

Dec. 21, 2012 (KR) ..... 10-2012-0150476

(51) Int. Cl.
*G09G 3/36* (2006.01)

(52) U.S. Cl.
CPC ..... *G09G 3/3611* (2013.01); *G09G 3/3614* (2013.01); *G09G 2320/0247* (2013.01)

(58) Field of Classification Search
CPC ..... G06F 3/041; G06F 3/045; G06F 5/00; G09G 3/36; G09G 3/34; G09G 5/00; G09G 3/18
USPC ..... 345/76, 204, 211, 212
See application file for complete search history.

(56) References Cited

U.S. PATENT DOCUMENTS

2006/0279514 A1* 12/2006 Yokota et al. ..... 345/100
2007/0030233 A1* 2/2007 Chai et al. ..... 345/98
2009/0167664 A1* 7/2009 Song ..... G09G 3/3614 345/94
2011/0316989 A1* 12/2011 Imai ..... G02B 27/2214 348/51
2012/0013591 A1* 1/2012 Kim et al. ..... 345/211
2012/0256885 A1* 10/2012 Kwon et al. ..... 345/204
2012/0293495 A1* 11/2012 Yeo et al. ..... 345/419
2014/0071105 A1* 3/2014 Nakanishi et al. ..... 345/209

* cited by examiner

*Primary Examiner* — Pegeman Karimi
(74) *Attorney, Agent, or Firm* — Birch, Stewart, Kolasch & Birch, LLP

(57) ABSTRACT

Discussed is an LCD device. The LCD device according to an embodiment of the present invention includes a liquid crystal panel in which a plurality of pixels are respectively formed in a plurality of areas defined by intersections between a plurality of gate lines and a plurality of data lines, and a driving unit configured to switch inversion systems for driving the liquid crystal panel at predetermined periods.

12 Claims, 6 Drawing Sheets

FIG. 1

Related Art

| Frame (2n)th | | | | | |
|---|---|---|---|---|---|
| R | G | B | R | G | B |
| + | + | + | + | + | + |
| - | - | - | - | - | - |
| + | + | + | + | + | + |
| - | - | - | - | - | - |
| + | + | + | + | + | + |
| - | - | - | - | - | - |
| + | + | + | + | + | + |
| - | - | - | - | - | - |

(a)

| Frame (2n+1)th | | | | | |
|---|---|---|---|---|---|
| R | G | B | R | G | B |
| - | - | - | - | - | - |
| + | + | + | + | + | + |
| - | - | - | - | - | - |
| + | + | + | + | + | + |
| - | - | - | - | - | - |
| + | + | + | + | + | + |
| - | - | - | - | - | - |
| + | + | + | + | + | + |

(b)

FIG. 2

Related Art

| Frame (2n)th | | | | | |
|---|---|---|---|---|---|
| R | G | B | R | G | B |
| + | - | + | - | + | - |
| - | + | - | + | - | + |
| + | - | + | - | + | - |
| - | + | - | + | - | + |
| + | - | + | - | + | - |
| - | + | - | + | - | + |
| + | - | + | - | + | - |
| - | + | - | + | - | + |

(a)

| Frame (2n+1)th | | | | | |
|---|---|---|---|---|---|
| R | G | B | R | G | B |
| - | + | - | + | - | + |
| + | - | + | - | + | - |
| - | + | - | + | - | + |
| + | - | + | - | + | - |
| - | + | - | + | - | + |
| + | - | + | - | + | - |
| - | + | - | + | - | + |
| + | - | + | - | + | - |

(b)

(a)

(b)

LIQUID CRYSTAL DISPLAY DEVICE AND DRIVING METHOD THEREOF

CROSS-REFERENCE TO RELATED APPLICATION

This application claims priority to and the benefit of the Korean Patent Application No. 10-2012-0150476 filed on Dec. 21, 2012, which is hereby incorporated by reference as if fully set forth herein.

BACKGROUND OF THE INVENTION

1. Field of the Invention

Embodiment of the present invention relate to a liquid crystal display (LCD) device, and more particularly, to an LCD device using various inversion systems and a driving method thereof.

2. Discussion of the Related Art

With the advance of various portable electronic devices such as mobile communication terminals, smart phones, tablet computers, notebook computers, etc., demand for flat panel display (FPD) devices applicable to the portable electronic devices is increasing. Liquid crystal display (LCD) devices, plasma display panels (PDPs), field emission display (FED) devices, organic light emitting display devices, etc., are being actively researched as the FPD devices.

In such FPD devices, the LCD devices are being most widely commercialized at the present because the LCD devices are easily manufactured due to the advance of manufacturing technology, the drivability of a driver and a high-quality image, and The LCD devices drive a liquid crystal panel in various inversion systems, for preventing a deterioration of liquid crystal and enhancing a display quality. As inversion systems, there are a frame inversion system, a line Inversion system, a column inversion system, a dot inversion system, a Z-inversion system, etc.

FIG. 1 depicts diagrams for describing a general line inversion system, and especially, illustrates a horizontal 1-line inversion system. FIG. 2 depicts diagrams for describing a general dot inversion system, and especially, illustrates a vertical 1-dot and horizontal 1-dot inversion system.

In the above-described inversion systems, as illustrated in FIG. 1, the line inversion system inverts polarities of data voltages (supplied to respective pixels) in units of a horizontal line, and inverts polarities of data voltages in units of a frame.

A portion (a) of FIG. 1 illustrates polarities of data voltages in a 2nth frame, and a portion (b) of FIG. 1 illustrates polarities of data voltages in a 2n+1st frame. In the horizontal 1-line inversion system, polarities of data voltages supplied to respective pixels are inverted in units of a horizontal line in one frame, and, polarities of data voltages of the same horizontal line are inverted in units of a frame.

In the above-described inversion systems, as illustrated in FIG. 2, the dot inversion system inverts polarities of data voltages (supplied to respective pixels) in units of a dot, and inverts polarities of data voltages in units of a frame.

A portion (a) of FIG. 2 illustrates polarities of data voltages in a 2nth frame, and a portion (b) of FIG. 2 illustrates polarities of data voltages in a 2n+1st frame. In the vertical 1-dot and horizontal 1-dot inversion system, polarities of data voltages supplied to respective pixels are inverted in units of adjacent pixels in one frame, and, a polarity of a data voltage of the same pixel is inverted in units of a frame.

In addition, the above-described inversion systems invert polarities of data voltages supplied to respective pixels in various types.

The above-described inversion systems of the related art invert polarities of dots in units of a frame, and do not change an inversion method.

The inversion systems of the related art invert a polarity of a horizontal 1 line in units of a frame (horizontal 1-line inversion system), invert a polarity of vertical 1 dot and horizontal 1 dot (vertical 1-dot and horizontal 1-dot inversion system), or invert polarities of all dots in units of a frame (frame inversion system).

In LCD devices using the above-described inversion system of the related art, as described above, since a polarity of a dot is inverted in units of a frame and an inversion method is not changed, the following problems occur.

First, a transmittance difference occurs even in the same dot according to polarities.

Second, a transmittance difference between adjacent dots is caused by a polarity difference, causing visual flickers.

Third, flickers occur heavily in a screen vulnerable to a specific inversion driving method.

In LCD devices using the related art inversion system, since a process differential of a liquid crystal panel occurs and driving voltages of liquid crystal differ, a capacitance differential occurs in the liquid crystal panel. In this instance, when positive and negative polarities of 1 dot differ in level, a transmittance difference occurs, causing visual flickers. Also, regardless of inversion systems (inversion driving systems), there is a screen vulnerable to flickers, and for this reason, there is a limitation in reducing flickers due to a panel differential by using one inversion system.

SUMMARY OF THE INVENTION

Accordingly, embodiments of the present invention are directed to provide an LCD device and a driving method thereof that substantially obviate one or more problems due to limitations and disadvantages of the related art.

An aspect of the present invention is directed to provide an LCD device and a driving method thereof, which switch inversion systems at predetermined periods.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an LCD device including a liquid crystal panel in which a plurality of pixels are respectively formed in a plurality of areas defined by intersections between a plurality of gate lines and a plurality of data lines; and a driving unit configured to switch inversion systems for driving the liquid crystal panel at predetermined periods.

In another aspect of the present invention, there is provided a method of driving an LCD device, including switching inversion systems at predetermined periods; and converting image data into respective data voltages according to the switched inversion system, and outputting the respective data voltages to a plurality of data lines.

It is to be understood that both the foregoing general description and the following detailed description of the embodiments of the present invention are by example and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings:

FIG. 1 depicts diagrams for describing a general line inversion system;

FIG. 2 depicts diagrams for describing a general dot inversion system;

DETAILED DESCRIPTION OF THE EMBODIMENTS

Reference will now be made in detail to embodiments of the present invention, examples of which are illustrated in the accompanying drawings. Wherever possible, the same reference numbers will be used throughout the drawings to refer to the same or like parts.

Hereinafter, example embodiments of the present invention will be described in detail with reference to the accompanying drawings.

Figure 3:
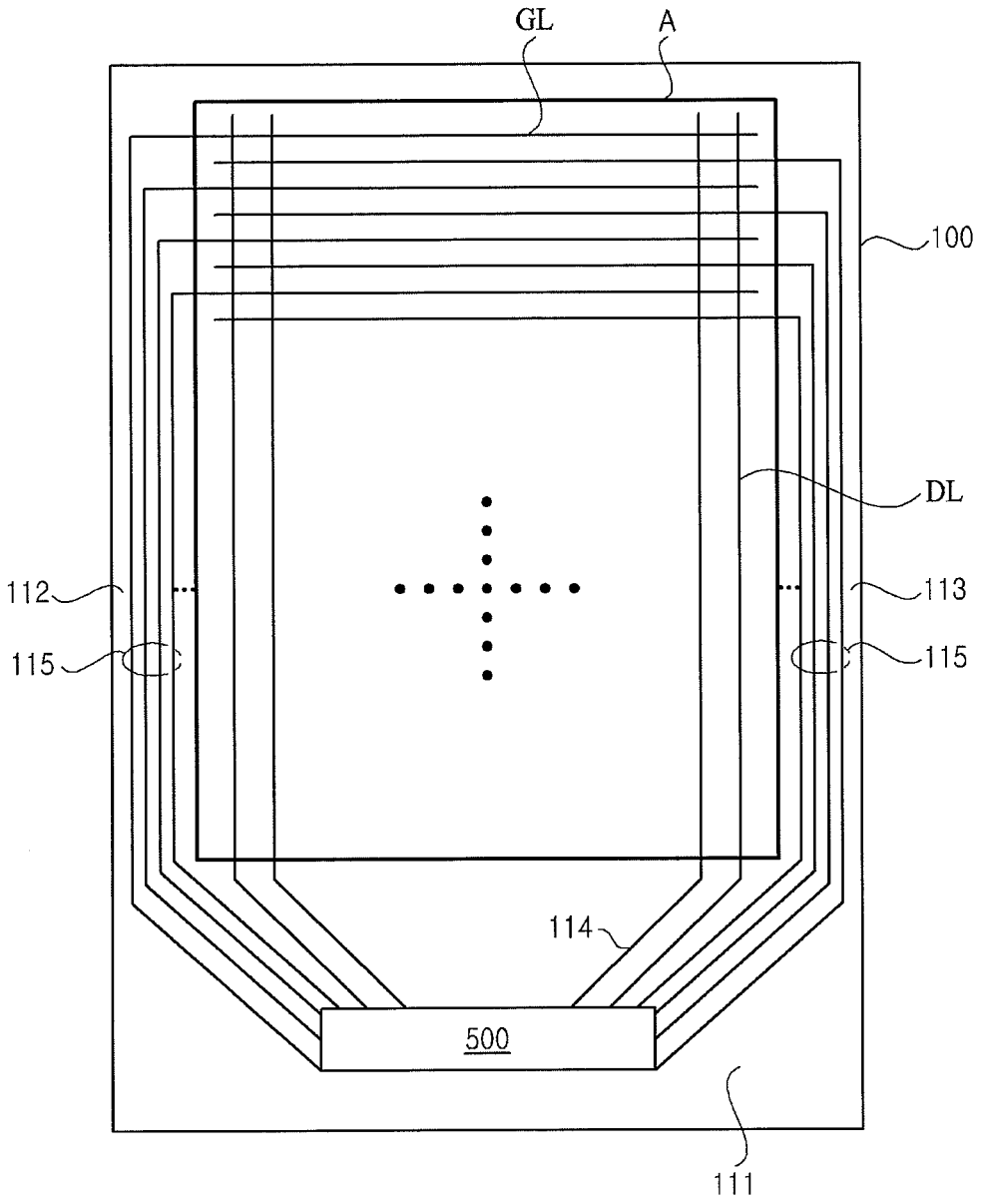
FIG. 3 is a diagram schematically illustrating an LCD device according to an embodiment of the present invention.
Figure 4:
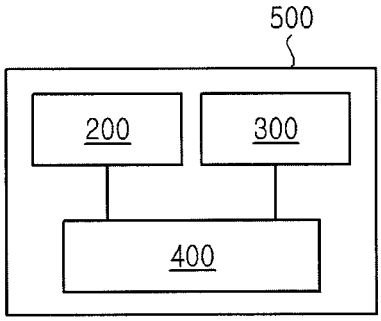
FIG. 4 is a diagram illustrating a configuration of a driving unit of FIG. 3 according to an embodiment of the present invention.
Figure 5:
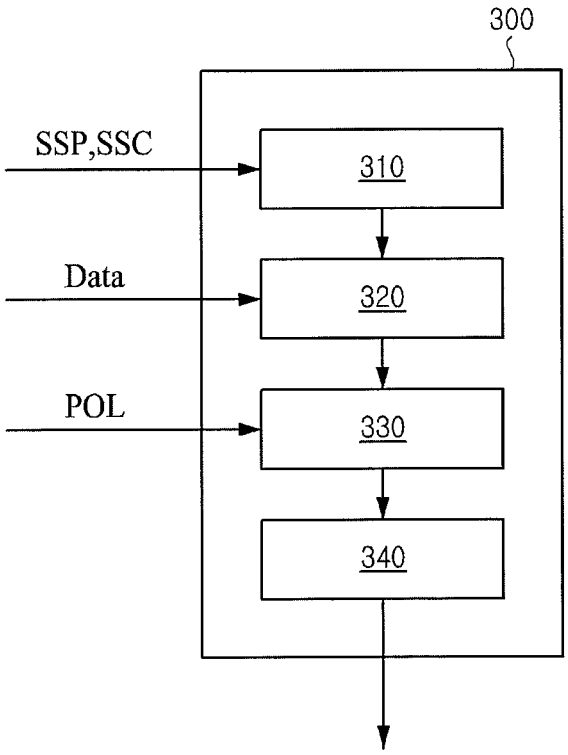
FIG. 5 is a diagram illustrating a configuration of a data driver of FIG. 4 according to an embodiment of the present invention.
Figure 6:
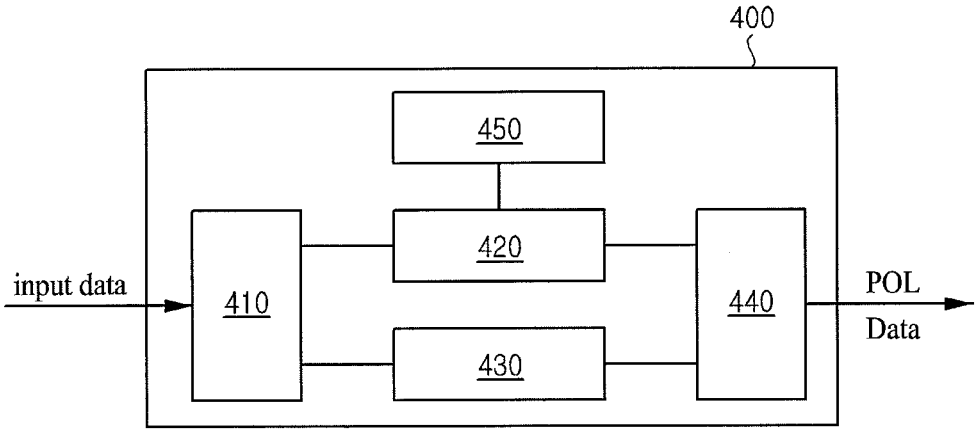
FIG. 6 is a diagram illustrating a configuration of a controller of FIG. 4 according to an embodiment of the present invention.

FIG. 3 is a diagram schematically illustrating an LCD device according to an embodiment of the present invention, FIG. 4 is a diagram illustrating a configuration of a driving unit of FIG. 3 according to an embodiment of the present invention, FIG. 5 is a diagram illustrating a configuration of a data driver of FIG. 4 according to an embodiment of the present invention, and FIG. 6 is a diagram illustrating a configuration of a controller of FIG. 4 according to an embodiment of the present invention.

Embodiments of the present invention relate to an LCD device and a driving method thereof, which switch inversion systems at predetermined periods, thus reducing flickers.

According to one or more embodiments of the present invention, inversion systems are sequentially switched in units of a specific frame, and thus can reduce flickers which are caused by a transmittance difference between adjacent dots due to a polarity change of each dot between frames.

According to one or more embodiments of the present invention, even though an image vulnerable to flickers occurs in a specific inversion system, flickers caused by a transmittance difference due to a polarity difference can be reduced by switching inversion systems in units of a specific frame.

To this end, as illustrated in FIG. 3, an LCD device according to an embodiment of the present invention includes a liquid crystal panel 100 in which a plurality of pixels are respectively formed in a plurality of areas defined by intersections between a plurality of gate lines GL and a plurality of data lines DL; and a driving unit 500 that switches at least two or more inversion systems for driving the liquid crystal panel 100 at predetermined periods.

First, the liquid crystal panel 100 includes a lower substrate and an upper substrate that are coupled to each other with a liquid crystal layer therebetween.

The lower substrate (TFT substrate) of the liquid crystal panel 100 includes the plurality of data lines DL, a plurality of thin film transistors (TFTs) respectively formed in a plurality of intersection areas between the data lines DL and the gate lines GL, a plurality of pixel electrodes for charging respective data voltages into the plurality of pixels which are respectively formed in the plurality of intersection areas between the data lines DL and the gate lines GL, and a common electrode for driving liquid crystal filled into the liquid crystal layer together with the pixel electrodes.

A plurality of sub-pixels are respectively formed in the plurality of areas in which the data lines DL intersect the gate lines GL. The sub-pixels may include a red (R) sub-pixel, a green (G) sub-pixel, and a blue (B) sub-pixel. Adjacent red, green, and blue sub-pixels configure one unit pixel (UP).

Each of the plurality of sub-pixels includes a TFT which is connected to a corresponding gate line and data line intersecting each other, a pixel electrode connected to the TFT, and a common electrode which is formed in correspondence with the pixel electrode and receives a common voltage.

A plurality of black matrixes (BM) and a plurality of color filters are formed in the upper substrate (CF substrate) of the liquid crystal panel 100. The common electrode may be formed in the upper substrate (CF substrate).

A polarizer (POL1) is adhered to the upper substrate of the liquid crystal panel 100, and a polarizer (POL2) is adhered to the lower substrate. An alignment layer for setting a pre-tilting angle of the liquid crystal is formed at an inner surface contacting the liquid crystal.

A column space (CS) for maintaining a cell gap may be formed between the upper substrate and lower substrate of the liquid crystal panel 100.

The liquid crystal panel 100 includes a display area A displaying an image and a plurality of non-display areas 111 to 113 which are formed outside the display area A and are incapable of displaying an image.

The gate lines GL and the data lines DL are formed to intersect in the display area A of the liquid crystal panel 100.

The driving unit 500 is disposed in a first non-display area 111 of the non-display areas of the liquid crystal panel 100, and a plurality of data link lines 114 for connecting the respective data lines DL to the driving unit 500 are formed in the first non-display area 111.

A plurality of gate link lines 115 for connecting the respective gate lines GL to the driving unit 500 are formed in each of second and third non-display areas 112 and 113 of the non-display areas of the liquid crystal panel 100.

Second, the driving unit 500 sequentially outputs a scan signal to the gate link lines 115, and outputs data voltages to the respective data lines DL. As illustrated in FIG. 4, the driving unit 500 includes a gate driver 200 that outputs the scan signal to the gate lines GL formed in the panel 100, a data driver 300 that outputs the data voltages to the respective data lines DL formed in the panel 100, and a controller 400 that controls a function of the gate driver 200 and a function of the data driver 300.

The data driver 300 converts digital image data, transferred from the controller 400, into data voltages, and supplies data voltages of one horizontal line to the respective data lines DL at every one horizontal period for which the scan signal is supplied to one gate line.

The data driver 300 converts the image data into the data voltages by using gamma voltages supplied from a gamma voltage generator, and outputs the data voltages to the respective data lines DL. To this end, as illustrated in FIG. 5, the data driver 300 includes a shift register 310, a latch 320, a digital-to-analog converter (DAC) 330, and an output buffer 340.

The shift register 310 generates a sampling signal by using data control signals (SSC, SSP, etc.) received from the controller 400.

The latch 320 latches the digital image data sequentially received from the controller 400, and then simultaneously outputs the latched image data to the DAC 330.

The DAC 330 simultaneously converts the image data, transferred from the latch 320, into positive or negative data voltages, and outputs the positive or negative data voltages. Specifically, the DAC 330 converts the image data into the positive or negative data voltages (data signals) by using a polarity control signal POL transferred from the controller 400, and outputs the positive or negative data voltages to the respective data lines DL.

Here, the polarity control signal POL is changed to various types and inputted to the DAC 330 by the controller 400.

The DAC 330 converts the image data into the respective data voltages by using a high-level driving voltage (VDD).

The output buffer 340 outputs the positive or negative data voltages, transferred from the DAC 330, to the respective data lines DL of the panel 100 according to a source output enable signal (SOE) transferred from the controller 400.

The controller 400 generates a gate control signal (GCS) for controlling an operation timing of the gate driver 200 (i.e., gate driver ICs) and a data control signal (DCS) for controlling an operation timing of the data driver 300 (i.e., data driver ICs) by using a plurality of timing signals, namely, a vertical sync signal (Vsync), a horizontal sync signal (Hsync), a data enable signal (DE), etc., inputted from an external system. Also, the controller 400 generates image data to be transferred to the data driver 300.

In other words, the controller 400 aligns input video data inputted from the external system according to a structure and characteristic of the panel 100, and transfers the aligned image data to the data driver 300.

To this end, as illustrated in FIG. 6, the controller 400 may include a data aligner 430.

Moreover, the controller 400 generates the data control signal (DCS) for controlling the data driver 300 and the gate control signal (GCS) for controlling the gate driver 200 by using the timing signals, namely, the vertical sync signal (Vsync), the horizontal sync signal (Hsync), the data enable signal (DE), etc., inputted from the external system. Also, the controller 400 generates the control signals to the data driver 300 and the gate driver 200, respectively.

To this end, as illustrated in FIG. 6, the controller 400 may include a control signal generator 420.

The gate control signal (GCS) generated by the control signal generator 420 includes a gate start pulse (GSP), a gate shift clock (GSC), a gate output enable signal (GOE), a gate start signal (VST), and a gate clock (GCLK).

The data control signal (DCS) generated by the control signal generator 420 includes a source start pulse (SSP), a source shift clock (SSC), the source output enable signal (SOE), and the polarity control signal POL.

The control signal generator 420 applied to an embodiment of the present invention may generate the polarity control signal POL in various inversion systems at predetermined periods, and transfer the polarity control signal POL to the data driver 300.

Here, the predetermined period may denote a period of "in units of one frame", "in units of two frames", "in units of three frame", "in units of four frames", or the like.

Moreover, various inversion systems may include at least two of a vertical 1-dot and horizontal 1-dot inversion system (V1H1), a vertical 2-dot and horizontal 1-dot inversion system (V2H1), a vertical 1-dot and horizontal 2-dot inversion system (V1H2), and a vertical 2-dot and horizontal 2-dot inversion system (V2H2). In addition to such inversion systems, the various inversion systems may further include a frame inversion system, a line inversion system, and a column inversion system.

The controller 400 may select at least two inversion systems from among the various inversion systems which are currently used for the LCD device, and generate the polarity control signal POL to transfer the polarity control signal POL to the data driver 300 according to the selected inversion systems and the predetermined period.

The controller 400 may include a storage 450 that stores the inversion systems and the predetermined period. However, the storage 450 may be included in the driving unit 500 instead of the controller 400.

The gate driver 200 includes a plurality of stages for sequentially outputting the scan signal to the gate lines GL.

The gate driver 200 may be included in the driving unit 500 implemented as an integrated circuit (IC). In this instance, the stages are included in the driving unit 500.

The stages may be disposed in a gate-in panel (GIP) type in each of the second and third non-display areas 112 and 113.

Figure 7:
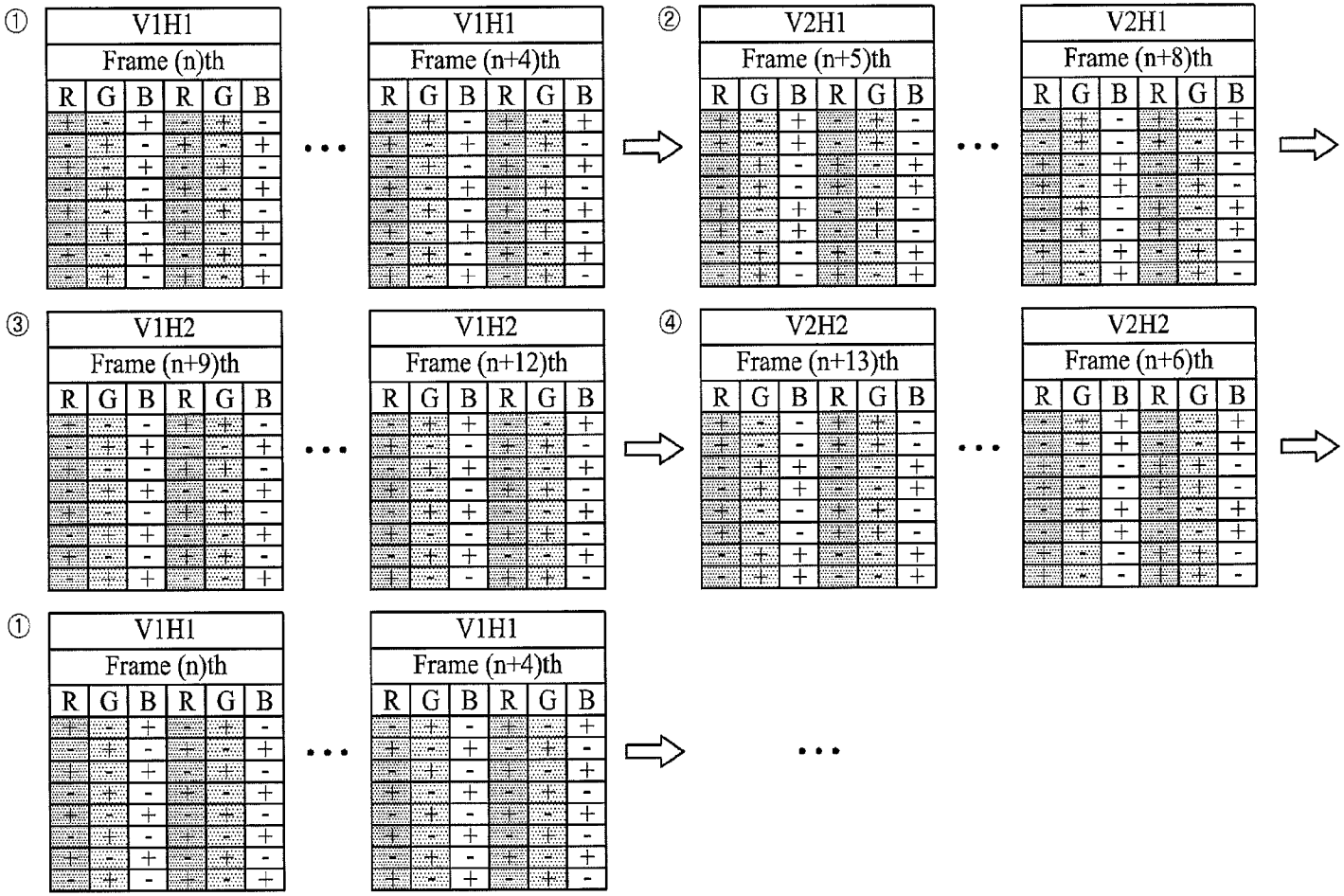
FIG. 7 depicts diagrams illustrating polarities of data voltages outputted to a liquid crystal panel of an LCD device according to an embodiment of the present invention.
Figure 8:
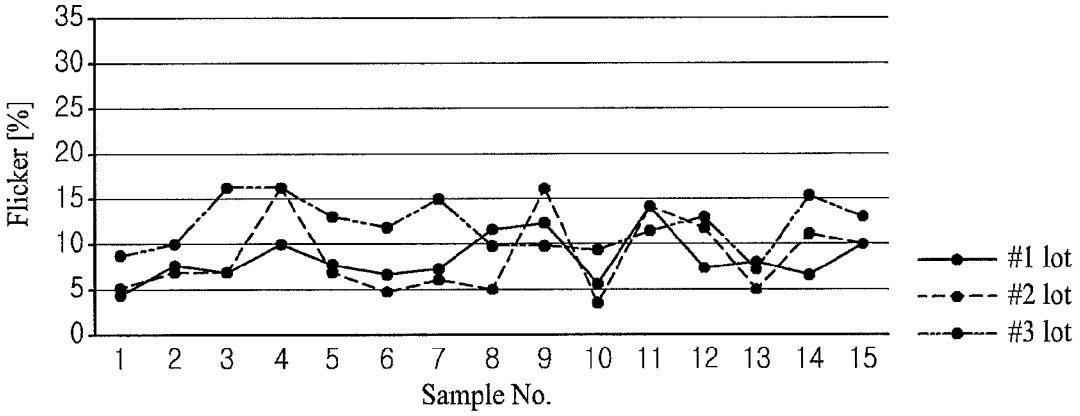
FIG. 8 depicts graphs that compare flickers in an LCD device according to an embodiment of the present invention with flickers in a related art LCD device.
Figure 8:
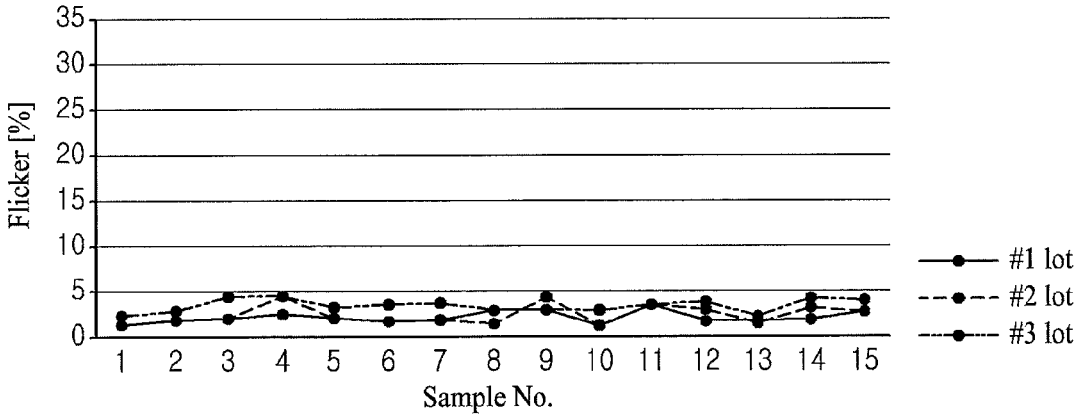

FIG. 7 depicts diagrams illustrating polarities of data voltages outputted to the liquid crystal panel of an LCD device according to an embodiment of the present invention. FIG. 8 depicts graphs that compare flickers in the LCD device according to an embodiment of the present invention with flickers in a related art LCD device, a portion (a) of FIG. 8 is a graph that shows the flickers in the related art LCD device, and a portion (b) of FIG. 8 is a graph that shows the flickers in the LCD device according to an embodiment of the present invention.

In inversion systems applied to an embodiment of the present invention, as described above, there may be all inversion systems which are being used at the present. That is, the LCD device and a driving method thereof according to an embodiment of the present invention may apply the vertical 1-dot and horizontal 1-dot inversion system (V1H1), the vertical 2-dot and horizontal 1-dot inversion system (V2H1), the vertical 1-dot and horizontal 2-dot inversion system (V1H2), the vertical 2-dot and horizontal 2-dot inversion system (V2H2), the frame inversion system, the line inversion system, the column inversion system, a Z-inversion system, etc. Two or more of such inversion systems, especially, may be applied to an embodiment of the present invention.

In the following description, for convenience, it is assumed that the vertical 1-dot and horizontal 1-dot inversion system (V1H1), the vertical 2-dot and horizontal 1-dot inversion system (V2H1), the vertical 1-dot and horizontal 2-dot inversion system (V1H2), and the vertical 2-dot and horizontal 2-dot inversion system (V2H2) are applied to an embodiment of the present invention.

The embodiments of the present invention may sequentially switch the inversion systems in units of at least one frame.

As described above, when the embodiment of the present invention uses four inversion systems, the controller 400 may switch the inversion systems in units of one frame.

Specifically, the driving unit 500 may output data voltages to the respective data lines DL according to the vertical 1-dot and horizontal 1-dot inversion system (V1H1) in a first frame, output data voltages to the respective data lines DL according to the vertical 2-dot and horizontal 1-dot inversion system (V2H1) in a second frame, output data voltages to the respective data lines DL according to the vertical 1-dot and horizontal 2-dot inversion system (V1H2) in a third frame, and output data voltages to the respective data lines DL according to the vertical 2-dot and horizontal 2-dot inversion system (V2H2) in a fourth frame.

Moreover, the driving unit 500 may sequentially switch the four inversion systems in units of four frames.

The driving unit 500, as illustrated in FIG. 7, may output data voltages to the respective data lines DL according to the vertical 1-dot and horizontal 1-dot inversion system (V1H1) during nth to n+4th frames, output data voltages to the respective data lines DL according to the vertical 2-dot and horizontal 1-dot inversion system (V2H1) during n+5th to n+8th frames, output data voltages to the respective data lines DL according to the vertical 1-dot and horizontal 2-dot inversion system (V1H2) during n+9th to n+12th frames, output data voltages to the respective data lines DL according to the vertical 2-dot and horizontal 2-dot inversion system (V2H2) during n+13th to n+16th frames, and again output data voltages to the respective data lines DL according to the vertical 1-dot and horizontal 1-dot inversion system (V1H1) during n+17th to n+20th frames.

Here, the output order of the four inversion systems may be variously changed.

That is, the driving unit 500 may output data voltages in the order of the vertical 1-dot and horizontal 1-dot inversion system (V1H1), vertical 1-dot and horizontal 2-dot inversion system (V1H2), vertical 2-dot and horizontal 1-dot inversion system (V2H1), and vertical 2-dot and horizontal 2-dot inversion system (V2H2).

In addition, the driving unit 500 may switch the various inversion systems according to various periods and orders, and output data voltages. For example, the driving unit 500 may continually cycle through the various inversion systems in a predetermined order for an entire operating period of the driving unit 500, or may vary the order of the various inversion system periodically or randomly. Thus, instead of cycling through the shown order of the vertical 1-dot and horizontal 1-dot inversion system (V1H1), vertical 1-dot and horizontal 2-dot inversion system (V1H2), vertical 2-dot and horizontal 1-dot inversion system (V2H1), and vertical 2-dot and horizontal 2-dot inversion system (V2H2) of FIG. 7, the driving unit 500 may change the order of the various inversion system at an intermediate point in the operation period of the driving unit 500. Such order change may only occur once, or may occur multiple times during the operation period of the driving unit 500.

According to an embodiment of the present invention, as shown in FIG. 8, it can be seen that flickers are reduced. The portion (a) of FIG. 8 is the graph that shows flickers in the related art LCD device, and particularly, is a graph that shows flickers in the related art LCD device driven in the vertical 2-dot and horizontal 1-dot inversion system (V2H1). The portion (b) of FIG. 8 is the graph that shows flickers in the LCD device according to an embodiment of the present invention, and particularly, is a graph that shows flickers in the LCD device driven in the order of the vertical 1-dot and horizontal 1-dot inversion system (V1H1), vertical 2-dot and horizontal 1-dot inversion system (V2H1), vertical 1-dot and horizontal 2-dot inversion system (V1H2), and vertical 2-dot and horizontal 2-dot inversion system (V2H2).

That is, in FIG. 8, it can be seen that flickers in the LCD device according to an embodiment of the present invention are reduced compared to the related art LCD device.

According to an embodiment of the present invention, since inversion systems are switched at predetermined periods, flickers can be reduced.

Moreover, by periodically changing inversion systems, a transmittance change due to a polarity difference between adjacent dots is periodically counteracted, thus reducing flickers.

Moreover, by periodically switching four inversion systems, flickers can be reduced by a maximum of about one-fourth compared to an instance using one inversion system.

It will be apparent to those skilled in the art that various modifications and variations can be made in the embodiments of the present invention without departing from the spirit or scope of the inventions. Thus, it is intended that the embodiments of the present invention cover the modifications and variations of this invention provided they come within the scope of the appended claims and their equivalents.

What is claimed is:

1. A liquid crystal display (LCD) device comprising:

a liquid crystal panel in which a plurality of pixels are respectively formed in a plurality of areas defined by intersections between a plurality of gate lines and a plurality of data lines; and a driving unit configured to convert image data into respective data voltages by applying a first inversion system to a fourth inversion system in a first frame to a fourth frame, respectively, which are immediately adjacent frames for driving the liquid crystal panel during an operating period of the driving unit, and output the respective data voltages to all of the plurality of data lines during the first to fourth frames, wherein the driving unit changes an order of the first inversion system to the fourth inversion system at an intermediate point during the operating period of the driving unit.

2. The LCD device of claim 1, wherein the first to fourth inversion systems comprise a vertical 1-dot and horizontal 1-dot inversion system (V1H1), a vertical 2-dot and horizontal 1-dot inversion system (V2H1), a vertical 1-dot and horizontal 2-dot inversion system (V1H2), and a vertical 2-dot and horizontal 2-dot inversion system (V2H2).

3. The LCD device of claim 2, wherein the driving unit sequentially switches the first to fourth inversion systems in units of at least one frame for each inversion system.

4. The LCD device of claim 2, wherein the driving unit sequentially switches the first to fourth inversion systems in units of one frame for each inversion system.

5. The LCD device of claim 2, wherein the driving unit sequentially switches the first to fourth inversion systems in units of four frames for each inversion system.

6. A method of driving a liquid crystal display (LCD) device including a driving unit and a liquid crystal panel, the method comprising:

converting, via the driving unit, image data into respective data voltages by applying a first inversion system to a fourth inversion system in a first frame to a fourth frame, respectively, which are immediately adjacent frames for driving the liquid crystal panel during an operating period of the driving unit; and outputting, via the driving unit, the respective data voltages to all of a plurality of data lines during the first to the fourth frames, wherein the driving unit changes an order of the first inversion system to the fourth inversion system at an intermediate point during the operating period of the driving unit.

7. The method of claim 6, wherein the first to fourth inversion systems comprise a vertical 1-dot and horizontal 1-dot inversion system (V1H1), a vertical 2-dot and horizontal 1-dot inversion system (V2H1), a vertical 1-dot and horizontal 2-dot inversion system (V1H2), and a vertical 2-dot and horizontal 2-dot inversion system (V2H2).

8. The method of claim 7, wherein the converting comprises sequentially switching the first to fourth inversion systems in units of at least one frame for each inversion system.

9. The method of claim 7, wherein the converting comprises sequentially switching the first to fourth inversion systems in units of one frame for each inversion system.

10. The method of claim 7, wherein the converting comprises sequentially switching the first to fourth inversion systems in units of four frames for each inversion system.

11. A liquid crystal display (LCD) device comprising:

a liquid crystal panel in which a plurality of pixels are respectively formed in a plurality of areas defined by intersections between a plurality of gate lines and a plurality of data lines; and a driving unit configured to:

sequentially convert image data into respective data voltages by applying a first inversion system to a fourth inversion system in a first frame to a fourth frame, respectively, which are immediately adjacent frames for driving the liquid crystal panel during an operating period of the driving unit, and output the respective data voltages to all of the plurality of data lines during the first to fourth frames, wherein the driving unit changes an order of the first inversion system to the fourth inversion system at an intermediate point during the operating period of the driving unit.

12. The LCD device of claim 11, wherein the first to fourth inversion systems comprise a vertical 1-dot and horizontal 1-dot inversion system (V1H1), a vertical 2-dot and horizontal 1-dot inversion system (V2H1), a vertical 1-dot and horizontal 2-dot inversion system (V1H2), and a vertical 2-dot and horizontal 2-dot inversion system (V2H2).

* * * * *